US005933896A

United States Patent [19]

Gallina

[11] Patent Number: 5,933,896

[45] Date of Patent: Aug. 10, 1999

[54] SPORTS BOOT MANUFACTURE

[75] Inventor: Renato Gallina, Onigo de Pedarobba, Italy

[73] Assignee: Rem's srl, Pederobba, Italy

[21] Appl. No.: 08/765,770

[22] PCT Filed: Jul. 10, 1995

[86] PCT No.: PCT/GB95/01620

§ 371 Date: Mar. 7, 1997

§ 102(e) Date: Mar. 7, 1997

[87] PCT Pub. No.: WO96/01574

PCT Pub. Date: Jan. 25, 1996

[30] Foreign Application Priority Data

Jul. 8, 1994 [GB] United Kingdom ..... 9413827

[51] Int. Cl.[6] ..... A43B 13/38

[52] U.S. Cl. ..... 12/142 P; 12/142 T; 36/12

[58] Field of Search ..... 36/12, 18, 19 R, 36/46.5, 21; 12/142 T, 142 P

[56] References Cited

U.S. PATENT DOCUMENTS 2,022,760 12/1935 Engel .
2,473,605 6/1949 Orlando .
3,404,468 10/1968 Elliott .
4,918,776 4/1990 Motoda .

FOREIGN PATENT DOCUMENTS 342118 12/1959 Sweden .
721 957 1/1955 United Kingdom .
957 007 4/1964 United Kingdom .

*Primary Examiner*—Ted Kavanaugh
*Attorney, Agent, or Firm*—Madson & Metcalf

[57] ABSTRACT

A method of making a sports boot having an upper and a flexible material, an outsole and an insole. The insole having a heel region and forwardly projected portion having an outer edge profile which is stepped inwardly. The lower edges of the upper are folded inwardly and stitched to the inwardly stepped edge profile of the forwardly projecting portion of the insole forming a coplanar assembly of the insole and facing edges, stitching the facing edges to form a boot sub-assembly, applying the boot assembly to a last, folding and securing the lower edges of the upper to the heel region of the insole and securing the outsole to the sub-assembly to complete the formation of the boot.

4 Claims, 4 Drawing Sheets

SPORTS BOOT MANUFACTURE

Thus application is a 371 of PCT/GB95/01620 filed on Jul. 10, 1995.

This invention relates to a method of making a sports boot.

The type of sports boot with which the invention is concerned includes sports boots used to play football, rugby, and many other types of ball games.

Traditional manufacture of football and rugby boots and the like have used relatively heavy "uppers" of leather or other material, and with relatively rigid, and thick soles joined to the edges of the upper. However, requirements of modern sportsmen now demand much lighter-weight designs of boot, with lightweight uppers and soles, but, this imposes problems not yet fully solved by existing techniques, at least by modern mass production techniques.

The invention seeks to address this problem, and to provide a novel solution resulting in easier manufacture of a lightweight sports boot.

A method of making a lightweight sports boot according to the invention utilises a relatively lightweight upper of flexible material, an outsole, and an insole with the lower edges of the upper secured to the insole and with the insole and the edges of the upper being secured to the outsole, and said method comprising:

folding the lower edges of the upper inwardly and stitching at least part of said edges to the facing edges of an insole, which are located inwardly of the edges of said upper and substantially coplanar with the folded edges to form a midsole, and thereby to form a part-assembly of a boot;

applying the boot part-assembly to a last; and, securing the outsole to the co-planar sub-assembly on the last to complete the formation of the boot.

An additional over-liner may be fitted within the boot to overly the co-planar sub-assembly of insole and folded-in edges of the upper.

The securement of the outsole may use any known adhesive or bonding techniques, and if desired a line of stitching may provide additional securement of the outsole to the sub-assembly.

The mid-sole therefore is located inwardly of the folded-in edges of the upper at least along the major part of the edges of the upper, but in the heel region of the boot, the mid-sole may be enlarged so as to fill substantially the entire support area within the boot for the heel portion of the wearer.

A preferred embodiment of method according to the invention will now be described in detail, by way of example only, with reference to the accompanying drawings, in which.

Figure 1:
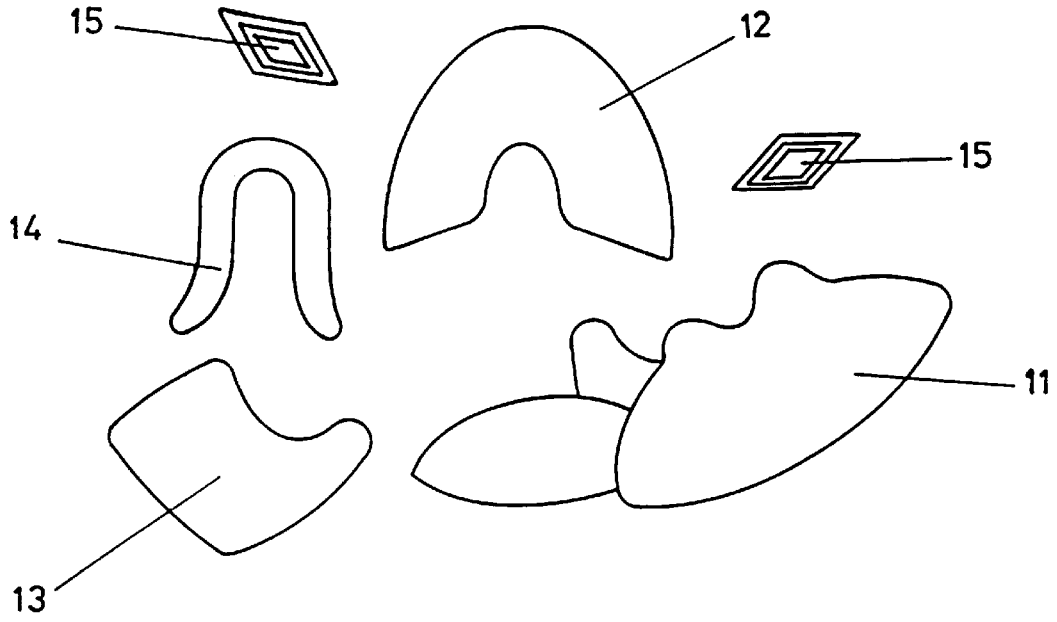
FIG. 1 is an exploded view of some of the individual components which can be assembled to form an "upper" of a sports boot to be made by a method according to the invention.

However, before giving a detailed description of one preferred example of method according to the invention, description will first be made of one existing technique for the manufacture of sports boots, such as football boots. First of all, an upper is cemented or otherwise secured to an insole board while it is located on the usual "last", and then an outsole is cemented to the insole board and to the upper. (The outsole may be flat, or may be formed with a concave underside to give a better fit on the underside of the last which is normally curved across its width). These operations take place on the last, (after assembly of the "upper" components, and fitting of the assembly on the last), until the finished shape of the boot has been obtained, and it is then removed.

By contrast, in the method according to the invention, a major part of the assembly i.e. a sub-assembly of the boot, is carried out before it is applied to the last, and then the completion of the sole assembly to the boot sub-assembly takes place on the last. By this means, a relatively light-weight and flexible material can be used in the formation of the upper, which, after formation in the sub-assembly, can be pulled onto the last almost like a sock, and then the outsole, usually of suitable plastics material, is then cemented, bonded, adhesively or otherwise secured directly to the bottom of the upper, and to the insole.

Thus, while the boot has an insole board, and an outsole, the means by which the insole is secured to folded-in edges of the upper, to form a substantially co-planar sub-assembly, effectively constitutes a type of "midsole". The stitching together of the folded-in edges of the upper to the midsole can take place using any suitable stitching techniques, and before the sub-assembly is applied to the last. This sub-assembly is readily pulled onto the last, and then the formation of the boot is completed by securing the outsole to the co-planar sub-assembly on the last.

Additional securement of the outsole to the sub-assembly may be obtained by applying a line of stitching closely adjacent to the outer periphery of the outsole.

An additional over-liner (known as an "insock") may be fitted within the boot, to overly the co-planar sub-assembly of midsole and folded-in edges of the upper.

The midsole is located inwardly of the folded-in and co-planar edges of the upper, along the major part of the lower periphery of the upper, but preferably in the region of the heel portion of the boot, the insole board forming the midsole widens-out to form a planar heel supporting area substantially filling the heel portion of the boot. Rivet, nail, stud and other means may be used to unite this enlarged heel portion of the insole board to the sole structure formed by the laminate of outsole, folded-in edges of the upper and the midsole.

Referring now to the Figures of drawings, a preferred embodiment of method according to the invention will now be described in detail, and which comprise an improvement to the existing "strobel" technique. Description will first be made of the formation of the boot sub-assembly from the component parts shown in FIGS. 1 to 6, and the method stages involved in completing the sub-assembly.

Figure 2:
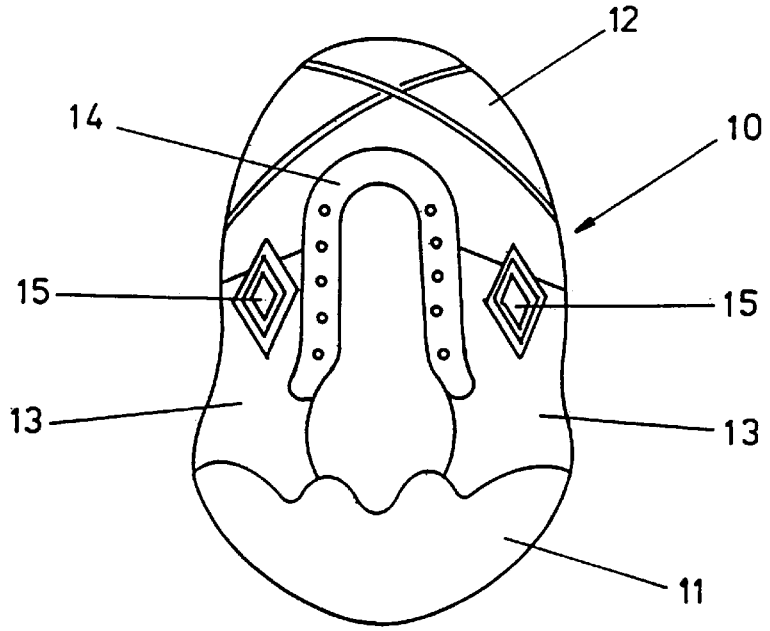
FIG. 2 is a view showing the components of the "upper" stitched together to form a closed form of upper ready to be lasted.

An assembled upper is shown in FIG. 2 and designated generally by reference 10, and the main individual components of the upper 10 are shown in FIG. 1, which are stitched together to form the upper 10. The components include toe portion 12, heel portion 11, side panels 13, U-shaped lace reinforcement 14 and decals 15. (There will usually be further components of the upper, but only the main ones have been described and illustrated herein).

Figure 3:
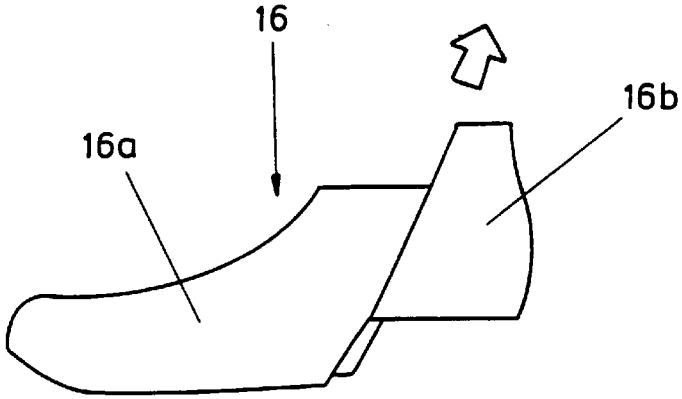
FIG. 3 is a schematic side view of a break-open last on which the upper can be fitted, to be joined to an insole and thereby form a boot sub-assembly.

After the components 11 to 15 have been stitched together, the upper 10 is formed and is ready now to be lasted, by being pulled over a last, as shown in FIG. 3, and which is designated generally by reference 16. The last 16 is of the break-open type, comprising a main portion 16*a* to fit within the forward part of the boot and a removable heel portion 16*b*. The last 16 therefore can readily be opened, after completion of the sub-assembly, to allow the boot sub-assembly to be removed. The last 16 may be attached to a strobel stitching machine (not shown) to form an integral component thereof.

Figure 4:
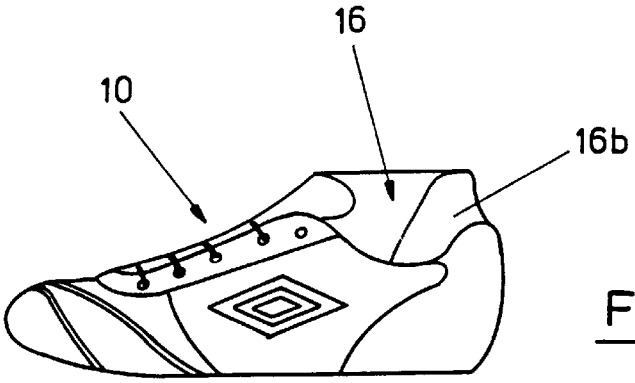
FIG. 4 is a side view showing the upper fitted on the last of FIG. 3.
Figure 5:
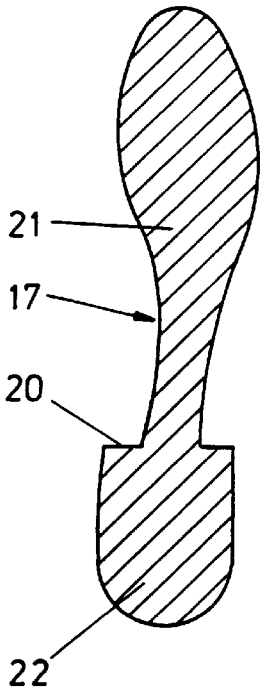
FIG. 5 is a plan view of an insole board which can be securely joined to the upper, when both are assembled on the last of FIG. 3.

FIG. 4 shows the upper 10 fitted on the two part last 16.

Figure 6:
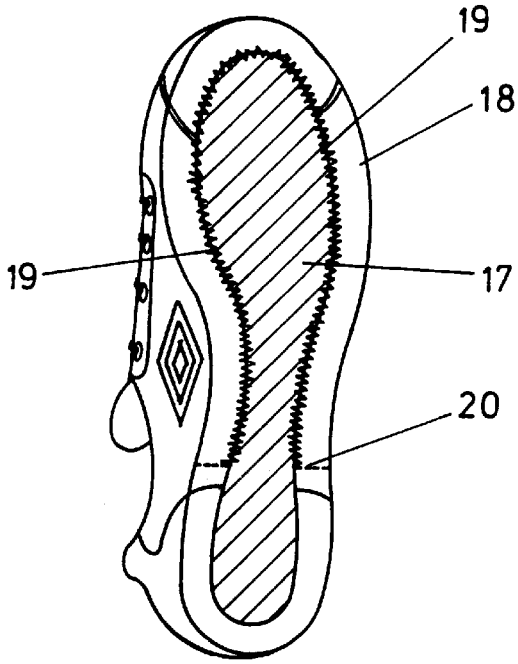
FIG. 6 is a perspective view from the underside of the boot sub-assembly, comprising the upper and insole board joined together.

To complete the boot sub-assembly, an insole board of a rigid material 17 is joined to the lower edges of the upper, partly by stitching, and partly by cementing or other adhesion, to give a boot sub-assembly as can be seen from the perspective view of the underside of the sub-assembly as shown in FIG. 6. The insole board 17 has a special shape, to facilitate the sub-assembly, as will become apparent from the description with reference to the further figures of drawings. FIG. 6 shows the folded over lower edges 18 of the upper 10, which are joined along the major part of their length to the insole board 17 by interlock stitching 19 while the upper 10 is pulled over the last 16. It will be seen from FIG. 6 that the line of stitching 19 extends along the edges of the insole board 17 in the forward (non-heel) region of the boot. However, in the heel area of the boot, the means of joining the insole board 17 to the upper 10 is different, and it can be seen from FIG. 6 that the line of interlock stitching 19 stops at a stepped transition line 20 and which is the transition between the narrow waisted portion 21 of the insole board 17, and the heel portion 22.

There has been described above, and illustrated in FIGS. 1 to 6, a novel method of forming a boot sub-assembly, and this operation can take place in the same boot-making factory at which the completion of the assembly is done, or the sub-assembly may be done in a separate factory.

Figure 10:
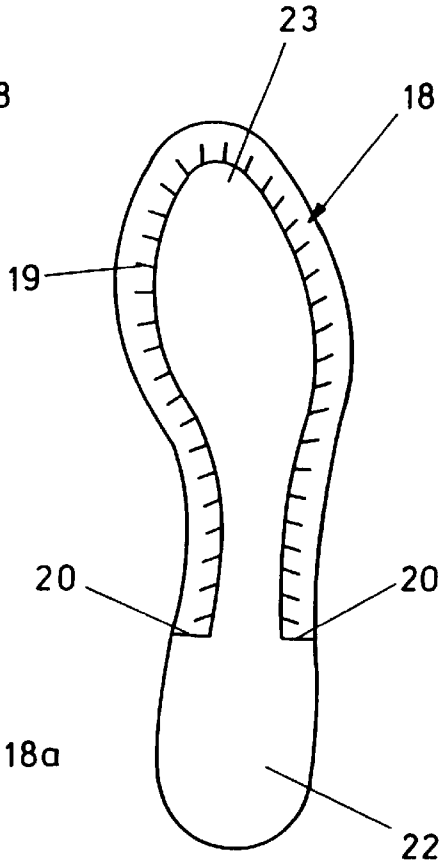
FIG. 10 is a plan view of the assembly of the insole board to the folded-in lower edges of the upper, but with the remainder of the upper omitted for clarity.
Figure 11:
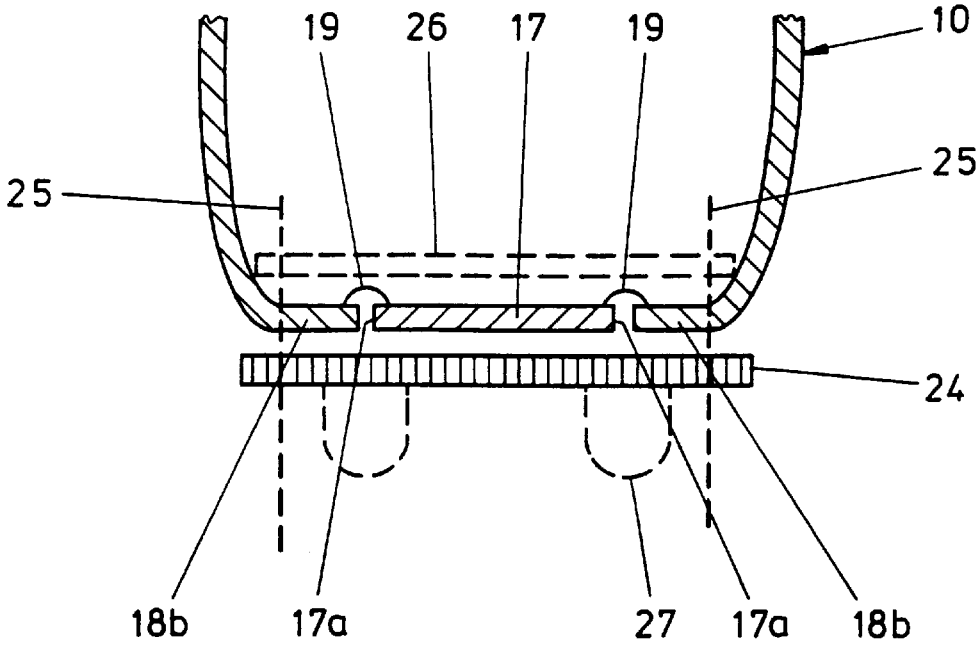
FIG. 11 is a cross-sectional view of the boot sub-assembly, and taken through a forward part of the boot, and showing completion of the assembly to an outsole which is securely joined thereto.
Figure 12:
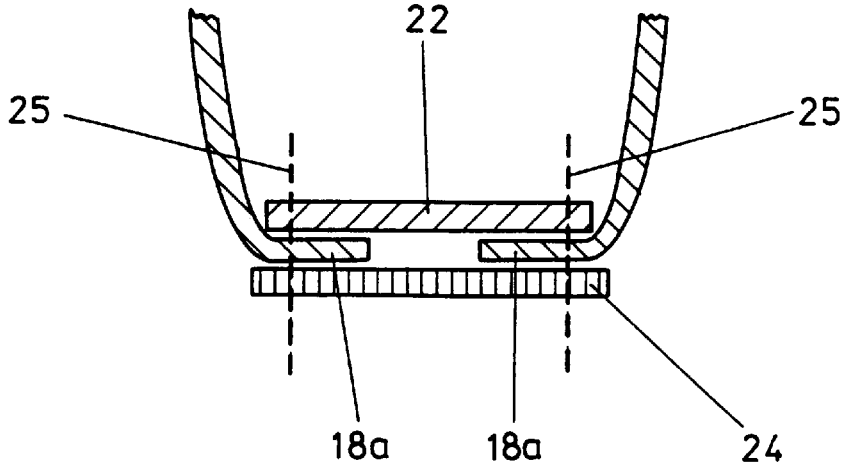
FIG. 12 is a sectional view, similar to FIG. 11, but taken through the heel region of the boot.

Referring now to FIGS. 7 to 12, there will now be described in further detail the formation of the sub-assembly, and completion of the assembly of the boot by securement of an outsole to the sub-assembly, as can be seen in FIGS. 11 and 12.

Figure 8:
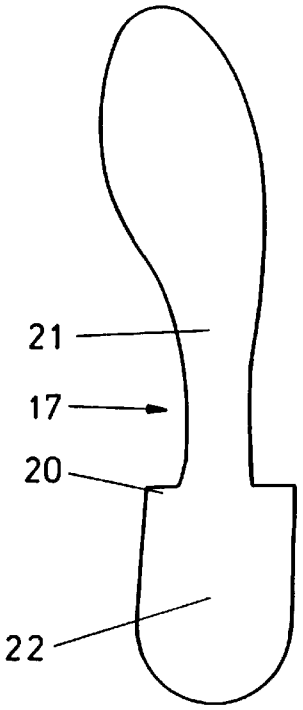
FIG. 8 is an underplan view, similar to FIG. 5, and showing the difference in size and shape between the profile of the last shown in FIG. 7, and that of the insole board.
Figure 7:
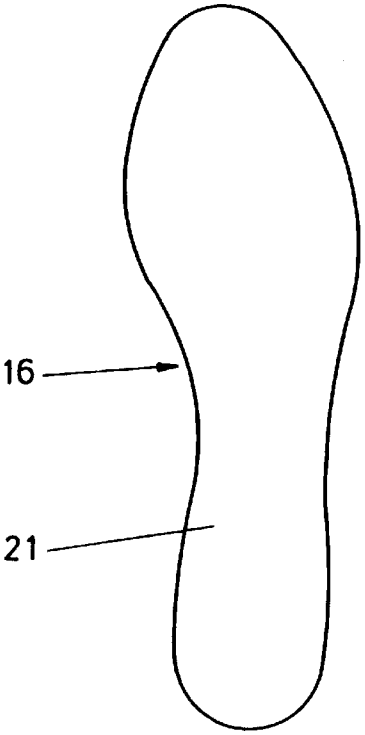
FIG. 7 is an underplan view of the profile of the last shown in FIG. 3.

FIG. 7 is an underplan view showing the profile shape of the last 16, and the external profile of the underside of the last 16 is shown by reference 21, whereas FIG. 8 shows the profile of the insole board 17 and in particular its smaller size when compared with the profile 21 of the last 16.

Figure 9:
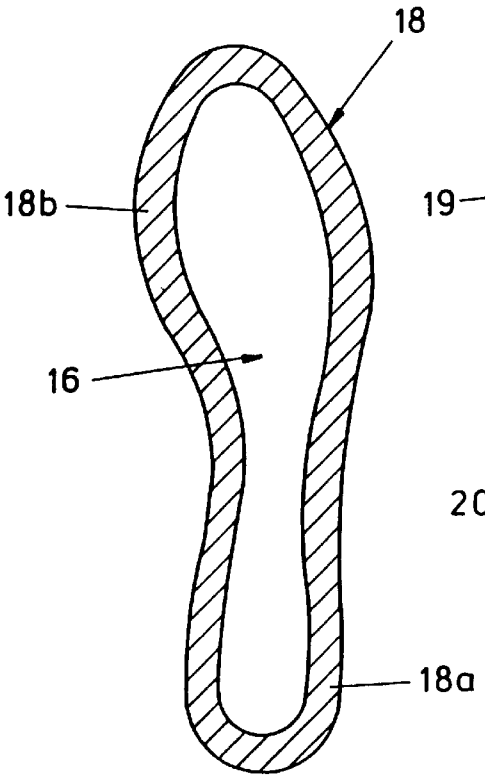
FIG. 9 is an underplan view of the folded over edges of the upper, when fitted on the last shown in FIG. 7.

FIG. 9 shows the folded over lower edges 18 of the upper 10, on the underside of the lower profile of the last 16, and FIG. 9 therefore also is an underplan view. By contrast, FIG. 10 is a plan view showing the insole board 17 overlying part of the edge of the upper, although the remainder of the upper is omitted for clarity. FIG. 10 shows the line of interlocking stitching 19 which runs around the periphery of insole board 17 forwardly from the stepped transition 20 towards the toe region 23, and then back to the other stepped region 20. This stitching is applied while the upper 10 and insole board 16 are fitted on the last 16. However, the heel region 22 of the insole board 17 is of substantially the same shape and size as the heel portion of the last 16, and therefore heel portion 22 overlies the edges 18 of the upper in the heel region of the boot.

As can be seen in FIG. 12, which is a sectional view through the heel region of the boot, the inwardly folded edges of the upper, designated by reference 18*a*, underlie the heel portion 22 of the insole board, and can be secured thereto by any convenient means, such as cement, adhesive and/or stitching. However, in the non-heeled region of the sub-assembly (see FIG. 11), ie along the length of the line of interlock stitching 19 running between stepped transition lines 20 and the toe region 23, the inwardly folded edges of the upper, designated by reference 18*b*, are coplanar with, and adjacent to the facing edges 17*a* of the insole board 17.

FIG. 11 is a typical sectional view in the non-heel region of the boot (between stepped lines 20 and the toe region 23 of FIG. 10), and also shows in dashed outline 26 a cushion type of additional liner which can overlie the sub-assembly of folded-in edges 18 of the upper and the specially shaped insole board (midsole) 17. FIG. 11 also shows in dotted outline a typical pair of boot studs 27 provided on the underside of the outsole 24.

The description above is mainly concerned with the stages involved in the formation of the sub-assembly, and this can be carried out in a separate factory, or within one factory as part of a complete formation of a sports boot.

After completion of the sub-assembly, the boot assembly is completed by securement of outsole 24 to the sub-assembly, and this can take place on a last (not shown) and by any suitable securement technique, eg adhesives, cement and/or stitching. By way of example, a peripheral internal line of stitching 25 is shown, which unites the outsole 24 to the sub-assembly, and in particular to the inwardly folded edges of the upper and to the insole board 17.

Therefore, in the method of the invention, effectively the specially profiled insole board 17 forms, in combination with the inwardly folded edges of the upper, a coplanar assembly which effectively is a "midsole" and this provides advantages in the assembly, and also enables a sports boot to be manufactured on a mass production basis with a light-weight upper, using sewn-in-sock type techniques previously only thought possible to be used with moccasin type shoes.

I claim:

1. A method of making a sports boot having an upper of flexible material which extends from a heel region to a toe region of the boot, an outsole secured to a lower edge of the upper and defining an outer edge of the boot which includes the heel region and the toe region, and an insole which comprises a rigid board which runs full length between the heel region and the toe region, said insole having (i) a heel portion which substantially fills the heel region of the boot and (ii) a forwardly projecting portion, in which the forwardly projecting portion has a outer edge profile which is stepped inwardly of the boot edge along a continuous line which extends forwardly along one side of the boot from the heel region to the toe region, along the toe region, and along the opposite side of the boot to the heel region, said method comprising:

folding the lower edges of the upper inwardly along both sides of the boot and along the toe region so as to face and to lie alongside the inwardly stepped edge profile of the forwardly projecting portion of the insole, and thereby to form a coplanar assembly of insole and facing edges;

stitching the facing edges together to form a boot sub-assembly;

applying the boot sub-assembly to a last;

folding over a lower edge of the upper at the heel region of the boot, so as to overlie the heel portion of the insole;

securing the lower edge of the upper at the heel region with the heel portion of the insole; and securing the outsole to the sub-assembly to complete the formation of the boot.

2. A method of making a sports boot according to claim 1, further comprising the step of securing a plurality of boot studs to the outsole.

3. A method according to claim 1, in which an additional over-liner is fitted within the boot to overlie the coplanar assembly of insole and folded-in facing edges of the upper.

4. A method according to claim 1, in which the outsole is secured to the sub-assembly by a line of stitching.

* * * * *